US006598888B2

(12) United States Patent
Meibock et al.

(10) Patent No.: US 6,598,888 B2
(45) **Date of Patent: *Jul. 29, 2003**

(54) IN-LINE ROLLER SKATE

(75) Inventors: Antonin A. Meibock, Cleveland, OH (US); John E. Svensson, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/261,224

(22) Filed: Sep. 30, 2002

(65) Prior Publication Data

US 2003/0025286 A1 Feb. 6, 2003

Related U.S. Application Data

(63) Continuation of application No. 10/068,595, filed on Feb. 6, 2002, now Pat. No. 6,499,748, which is a continuation of application No. 09/877,544, filed on Jun. 8, 2001, now Pat. No. 6,367,818, which is a continuation of application No. 09/587,374, filed on Jun. 1, 2000, now Pat. No. 6,254,110, which is a continuation of application No. 09/379,461, filed on Aug. 23, 1999, now Pat. No. 6,139,030, which is a continuation of application No. 09/209,321, filed on Dec. 9, 1998, now Pat. No. 6,152,459, which is a continuation of application No. 08/811,134, filed on Mar. 3, 1997, now Pat. No. 5,848,796, which is a continuation of application No. 08/484,467, filed on Jun. 7, 1995, now abandoned, which is a continuation of application No. 08/094,576, filed on Jul. 19, 1993, now Pat. No. 5,437,466.

(51) Int. Cl.[7] ..... A63C 17/02

(52) U.S. Cl. ..... 280/11.221; 280/11.211

(58) Field of Search ..... 280/11.221–11.228, 280/11.3, 11.231, 11.215; 36/115–118.6

(56) References Cited

U.S. PATENT DOCUMENTS

| | | | |
|---|---|---|---|
| 310,923 | A | 1/1885 | Wardwell |
| 334,739 | A | 1/1886 | Blum |

(List continued on next page.)

FOREIGN PATENT DOCUMENTS

| | | | |
|---|---|---|---|
| CA | 2038315 | AA | 9/1991 |
| CH | 602 147 | A | 7/1978 |

(List continued on next page.)

OTHER PUBLICATIONS

Alpina Catalog Excerpts (1991–1992).
Alpina Cross–Country Ski Boots catalog Excerpts (1990–1991).

(List continued on next page.)

*Primary Examiner*—Richard M. Camby
(74) *Attorney, Agent, or Firm*—Christensen O'Connor Johnson Kindness PLLC

(57) ABSTRACT

In-line roller skate including a soft, pliable, and comfortable shoe body having structural foot support components positioned in selected strategic areas such as the ball, heel, and ankle. The shoe body may be made of a material that allows air circulation for coolness. In one embodiment, the structural components are made of semi-rigid plastic that may be heat moldable to conform to the user's foot. The shoe sole may also include heat moldable materials so that it can be anatomically formed to the foot. The shoe is mounted on a frame that supports a plurality of in-line roller wheels and includes structure for easily removing and replacing the wheels. The shoe-frame connection may be laterally and longitudinally adjustable. A speed control or brake, which applies a frictional force downwardly onto some or all of the in-line roller wheels, is mounted on the frame. Canting adjustment is provided to allow the ankle support to be canted laterally or longitudinally.

10 Claims, 13 Drawing Sheets

U.S. PATENT DOCUMENTS

| | | | |
|---|---|---|---|
| 593,278 | A | 11/1897 | Moulton |
| 700,377 | A | 5/1902 | Sakrzewski |
| 829,900 | A | 8/1906 | Shelmire |
| 1,034,649 | A | 8/1912 | Rice |
| 1,371,623 | A | 3/1921 | Ickenroth |
| 1,524,286 | A | 1/1925 | Bried |
| 1,527,840 | A | 2/1925 | Chomin |
| 1,539,445 | A | 5/1925 | Van Buuren |
| 1,607,103 | A | 11/1926 | Sesby |
| 1,798,590 | A | 3/1931 | Collis |
| 1,801,205 | A | 4/1931 | Mirick |
| 1,868,548 | A | 7/1932 | Turner |
| 2,048,916 | A | 7/1936 | Bentzlin |
| 2,118,892 | A | 5/1938 | Mays |
| 2,120,987 | A | 6/1938 | Murray |
| 2,147,455 | A | 2/1939 | Murray |
| 2,179,592 | A | 11/1939 | Goettie |
| 2,218,209 | A | 10/1940 | Marshall |
| 2,362,824 | A | 11/1944 | Hueston |
| 2,644,692 | A | 7/1953 | Kahlert |
| 2,763,071 | A | 9/1956 | Napier |
| 2,868,553 | A | 1/1959 | Rieckman |
| 2,909,375 | A | 10/1959 | Warner |
| 2,998,260 | A | 8/1961 | Meyer |
| 3,112,119 | A | 11/1963 | Sweet |
| 3,224,785 | A | 12/1965 | Stevenson |
| 3,387,852 | A | 6/1968 | De Sarro |
| 3,437,344 | A | 4/1969 | Peterson |
| 3,767,220 | A | 10/1973 | Peterson |
| 3,807,062 | A | 4/1974 | Spier |
| 3,844,574 | A | 10/1974 | Kosono et al. |
| 3,901,520 | A | 8/1975 | McMahan |
| 3,963,252 | A | 6/1976 | Carlson |
| 3,999,772 | A | 12/1976 | Brennan |
| 4,003,582 | A | 1/1977 | Maurer |
| 4,058,324 | A | 11/1977 | Dallaire |
| 4,088,334 | A | 5/1978 | Johnson |
| 4,108,451 | A | 8/1978 | Scheck, Sr. |
| 4,181,227 | A | 1/1980 | Balstad |
| 4,275,895 | A | 6/1981 | Edwards |
| 4,295,547 | A | 10/1981 | Dungan |
| 4,351,537 | A | 9/1982 | Seidel |
| 4,385,456 | A | 5/1983 | Livernois et al. |
| 4,417,737 | A | 11/1983 | Suroff |
| 4,418,929 | A | 12/1983 | Gray |
| 4,453,726 | A | 6/1984 | Ziegler |
| 4,492,385 | A | 1/1985 | Olson |
| 4,531,537 | A | 7/1985 | Smith |
| 4,563,825 | A | 1/1986 | Tesser |
| 4,654,985 | A | 4/1987 | Chalmers |
| 4,657,265 | A | 4/1987 | Ruth |
| 4,666,169 | A | 5/1987 | Hamill et al. |
| 4,718,181 | A | 1/1988 | Olivieri |
| 4,719,926 | A | 1/1988 | Nelson |
| 4,773,658 | A | 9/1988 | Bourque et al. |
| 4,776,111 | A | 10/1988 | Crowley |
| 4,807,893 | A | 2/1989 | Huang |
| 4,811,498 | A | 3/1989 | Barret |
| D300,685 | S | 4/1989 | Le et al. |
| 4,826,183 | A | 5/1989 | Bratland et al. |
| 4,892,332 | A | 1/1990 | Jennings |
| 4,898,403 | A | 2/1990 | Johnson |
| 4,909,523 | A | 3/1990 | Olson |
| 4,932,675 | A | 6/1990 | Olson et al. |
| 4,936,295 | A | 6/1990 | Crane |
| 4,943,072 | A | 7/1990 | Henig |
| 4,943,075 | A | 7/1990 | Gates |
| 4,964,229 | A | 10/1990 | Laberge |
| 4,988,122 | A | 1/1991 | Saunders |
| D315,941 | S | 4/1991 | Olson et al. |
| 5,028,058 | A | 7/1991 | Olson |
| 5,031,341 | A | 7/1991 | Paris et al. |
| 5,046,746 | A | 9/1991 | Gierveld |
| 5,048,848 | A | 9/1991 | Olson et al. |
| 5,052,701 | A | 10/1991 | Olson |
| D321,393 | S | 11/1991 | Olson et al. |
| 5,067,736 | A | 11/1991 | Olson et al. |
| 5,068,956 | A | 12/1991 | Malewicz |
| 5,069,462 | A | 12/1991 | Murga |
| D323,540 | S | 1/1992 | Graham |
| 5,088,748 | A | 2/1992 | Koselka et al. |
| 5,090,138 | A | 2/1992 | Borden |
| D324,713 | S | 3/1992 | Rubin |
| 5,092,614 | A | 3/1992 | Malewicz |
| D327,360 | S | 6/1992 | Graham |
| D327,565 | S | 7/1992 | Graham |
| 5,129,663 | A | 7/1992 | Soo |
| 5,143,387 | A | 9/1992 | Colla |
| 5,171,032 | A | 12/1992 | Detmer |
| 5,171,033 | A | 12/1992 | Olson et al. |
| 5,177,884 | A | 1/1993 | Rullier |
| 5,184,834 | A | 2/1993 | Yu |
| D334,225 | S | 3/1993 | Graham |
| 5,190,301 | A | 3/1993 | Malewicz |
| 5,192,099 | A | 3/1993 | Ruitta |
| 5,211,409 | A | 5/1993 | Mitchell et al. |
| 5,226,875 | A | 7/1993 | Johnson |
| 5,253,882 | A | 10/1993 | Mitchell |
| 5,280,930 | A | 1/1994 | Smathers et al. |
| 5,280,931 | A | 1/1994 | Horton |
| D344,119 | S | 2/1994 | Johnson et al. |
| 5,331,752 | A | 7/1994 | Johnson et al. |
| 5,342,070 | A | 8/1994 | Miller et al. |
| 5,380,020 | A | 1/1995 | Arney et al. |
| 5,393,078 | A | 2/1995 | Bourdeau |
| 5,397,141 | A | 3/1995 | Hoshizaki et al. |
| 5,411,278 | A | 5/1995 | Wittmann |
| 5,437,466 | A | 8/1995 | Meibock et al. |
| 5,480,168 | A | 1/1996 | Chen |
| 5,499,461 | A | 3/1996 | Danezin et al. |
| 5,678,330 | A | 10/1997 | Van Dyke et al. |
| 5,775,008 | A | 7/1998 | Bussell et al. |
| 5,848,796 | A | 12/1998 | Meibock et al. |
| 6,139,030 | A | 10/2000 | Meibock et al. |
| 6,152,459 | A | 11/2000 | Meibock et al. |
| 6,168,172 | B1 | 1/2001 | Meibock et al. |
| 6,254,110 | B1 | 7/2001 | Meibock et al. |
| 6,367,818 | B2 | 4/2002 | Meibock et al. |

FOREIGN PATENT DOCUMENTS

| | | | |
|---|---|---|---|
| DE | 2 512 648 | A1 | 3/1983 |
| DE | 8 807 537 | U1 | 9/1988 |
| DE | 2 622 119 | A1 | 4/1989 |
| DE | G9208063.4 | | 10/1992 |
| EP | 0 521 288 | A | 11/1993 |
| EP | 0 567 948 | A1 | 11/1993 |
| EP | 0 568 878 | A1 | 11/1993 |
| EP | 0 596 281 | A1 | 5/1994 |
| FR | 1 136 599 | | 12/1956 |
| FR | 81 17812 | | 9/1981 |
| FR | 2 558 351 | A1 | 1/1984 |
| FR | 2 585 260 | B1 | 7/1985 |
| FR | 87 14884 | | 10/1987 |
| FR | 90 12977 | | 10/1990 |
| FR | 2 659 534 | A1 | 9/1991 |
| FR | 2 668 072 | A1 | 4/1992 |
| NL | 8004718 | A | 3/1982 |
| NL | 8700023 | A | 4/1988 |

OTHER PUBLICATIONS

Artex Cross–Country System Catalog Excerpts, Lebrev (1991–1992).

Dewall, J.H., Declaration with Exhibit A, Jun. 10, 2000.

Frederickson, M.J. Declaration with Exhibit A, Jun. 12, 2000.

Luedke, A.A., Declaration with Exhibit A, Jun. 9, 2000.

Nelson, G.A., Declaration with Exhibit A, Jun. 5, 2000.

Parduba, J., Declaration and Reference Photos and Memorandum, Nov. 1999.

Pavek, K.A., Declaration, Jun. 11, 2000.

Polk III, L.F., Declaration, pp. 1, 3, 4, 5, and 8, and Exhibits D and E, Jun. 12, 2000.

Sakamoto, R., Declaration with Exhibit A, Jun. 12, 2000.

Salomon Catalog Excerpts, Lebrev (1991–1992).

Stickler, G., Declaration with Exhibits kA and B, Jun. 12, 2000.

X–C Skate Blades, Reliable Racing Supply, Inc., advertisement in *Silent Sports,* Nov. 1991.

Fig. 2A.
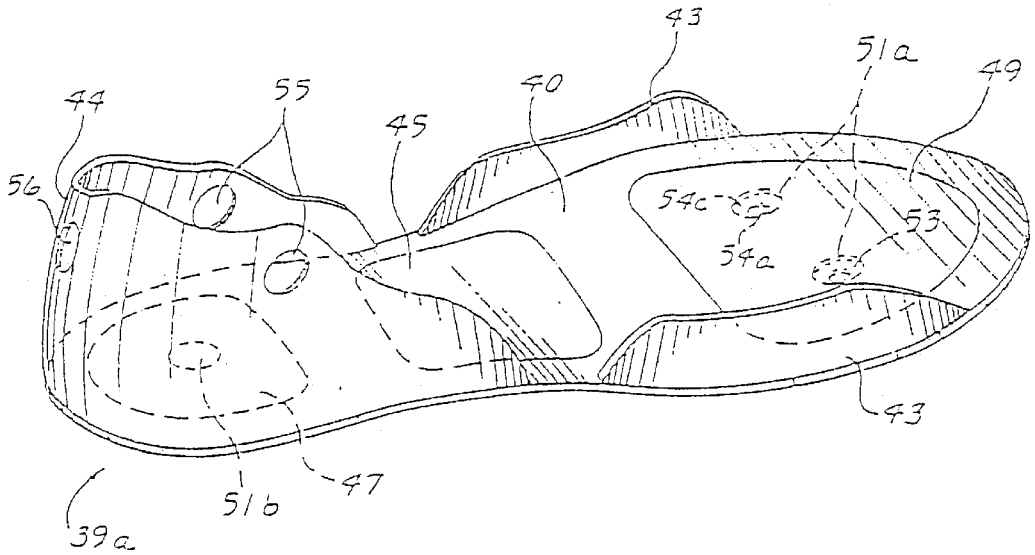
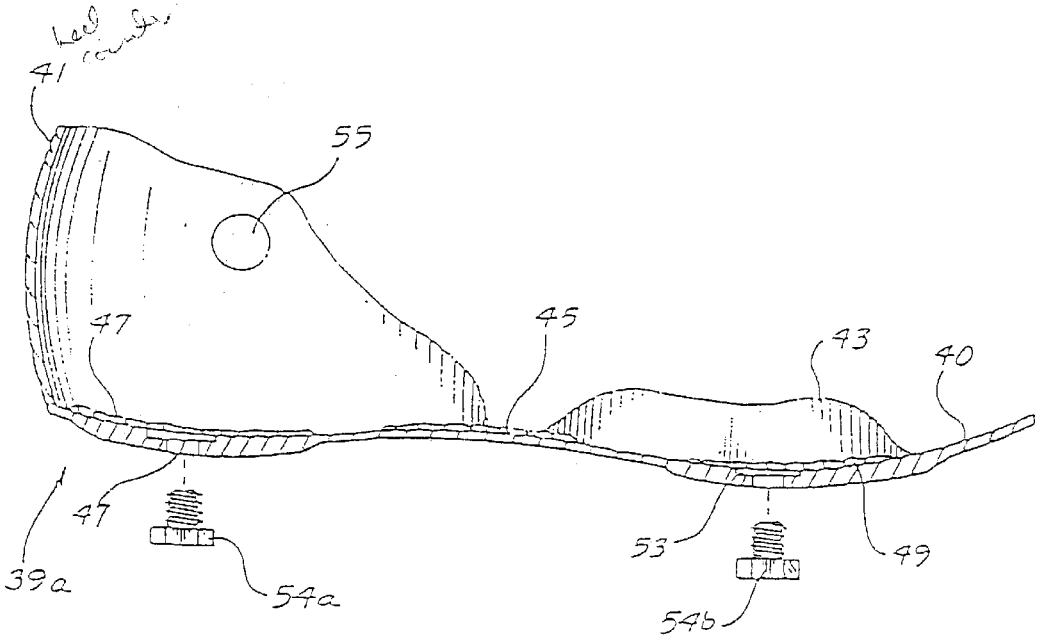
Fig. 3A.

75
77
71
61
67
35
35

75
71
65
61
35
35
67

IN-LINE ROLLER SKATE

CROSS-REFERENCES TO RELATED APPLICATIONS

This is a contiuation of U.S. patent application Ser. No. 10/068,595, filed Feb. 6, 2002 now U.S. Pat. No. 6,499,748, which is a continuation of prior application Ser. No. 09/877,544, filed Jun. 8, 2001 now U.S. Pat. No. 6,367,818, which is a continuation of application Ser. No. 09/587,374, filed Jun. 1, 2000 (now U.S. Pat. No. 6,254,110), which is a continuation of application Ser. No. 09/379,461, filed Aug. 23, 1999 (now U.S. Pat. No. 6,139,030), which is a continuation of application Ser. No. 09/209,321, filed Dec. 9, 1998 (now U.S. Pat. No. 6,152,459), which is a continuation of application Ser. No. 08/811,134, filed Mar. 3, 1997 (now U.S. Pat. No. 5,848,796), which is a continuation of application Ser. No. 08/484,467, filed Jun. 7, 1995, now abandoned, which is a continuation of application Ser. No. 08/094,576, filed Jul. 19, 1993 (now U.S. Pat. No. 5,437,466), priority from the filing date of which is hereby claimed under 35 U.S.C. §120.

FIELD OF THE INVENTION

The present invention generally relates to in-line roller skates having an upper shoe portion for securely holding the skater's foot connected by an appropriate fastening means to a lower frame portion which may include an in-line wheel brake or speed control system and means for quickly and easily replacing worn wheels.

BACKGROUND OF THE INVENTION

In-line roller skates generally include a plurality of wheels, mounted in-line, one behind the other, rotatable in a common, longitudinally extending, plane of rotation. The wheels are typically carried and supported by a lower frame portion attached to an in-line roller skate shoe or boot. A conventional in-line roller skate also includes an upper shoe (or boot) portion that is securely attached to the lower frame portion. The upper shoe portion provides the support for the skater's foot while the lower frame portion provides the rigid substructure or undercarriage for the in-line roller skate wheels.

In-line roller skates are very maneuverable and are capable of higher speeds than those customarily associated with conventional paired wheel roller skates. In-line roller skating is generally considered to require higher levels of skill, coordination, and strength than conventional paired wheel roller skating because of the narrow, lateral support base associated with in-line roller skates. Specifically, while balancing in the forward and rear direction is relatively easy for even inexperienced skaters, balancing in the sideward or lateral direction is difficult because of the narrow support base and is heavily dependent upon the skater's balancing and coordination skills. Proper ankle and foot supports within the upper shoe portion of the in-line roller skate aid in lateral balancing.

To obtain the optimum performance from an in-line roller skate, it is important that the in-line roller skate be maintained in a substantially vertical position. The upper shoe portion of the in-line roller skate serves competing purposes of providing support and comfort; comfort in a shoe not usually being associated with a high degree of support. In other words, the incorporation of rigid support structures in the upper shoe portion of the in-line roller skate tends to add stiffness and bulk, and, considering the warm weather environments conducive to in-line roller skating, tends to make the skates, heavy, hot, and uncomfortable. Because serious ankle and other injuries can result if comfort is favored over support, proper support in an in-line roller skate has been the dominant design criteria in the past.

In prior designs, the conventional upper shoe portion of the in-line roller skate is usually formed of rigid, non-breathable, plastic materials having an inner liner. The plastic material generally forms the outer structure of the upper shoe portion, thereby requiring that a soft inner liner of sponge rubber or other like material be included to provide a modicum of comfort to the user. Since such soft materials combined with the rigid plastic shell are good insulators and do not readily transmit heat or air away from the user's foot, the result is a hot upper shoe portion.

To provide lateral stability, conventional alpine ski boot designs have readily been adapted to in-line roller skates. These boots provide support and durability characteristics necessary for in-line roller skates. U.S. Pat. Nos. 4,351,537 and 5,171,033 are both exemplary of rigid injection molded boots adapted to winter sports, such as ice skating and alpine skiing, which have been modified for in-line roller skating applications. These patents disclose an upper boot portion, which comprises a hard plastic outer shell with a soft inner liner. While this type of boot design is well-suited for cold weather sports, the upper shoe portion tends to be hot and uncomfortable when used in warm weather sports such as in-line roller skating. The '033 patent suggests that by including "primarily unobstructed ventilation ports" in the rigid synthetic outer shell of the upper shoe portion, air can circulate around the skater's foot, thereby eliminating some of the heat associated with the hard plastic outer shell. While this patent seeks to address the issue of comfort, the disclosed upper shoe portion is still configured of two parts, including a hard plastic outer shell and a soft inner liner, which in warm weather conditions can be uncomfortable, compared to conventional walking and/or running shoes due to excessive heat buildup. The result is that the skater's feet are often hot, damp, and uncomfortable.

Another problem with the adoption of injection molded ski-type boots to in-line roller skating is that while providing excellent lateral stiffness and rigidity for lateral ankle support, these boots also create unnecessary and unwanted forward/rearward stiffness and rigidity. Ski-type boots detract from the performance characteristics of the skate because they limit the range of motion of the skater's legs and feet and therefore, the ability of the skater to utilize the full extent of his strength and agility.

Further, it is desirable for an in-line roller skate upper shoe portion to be lightweight. Boots that are well-suited to skiing applications wherein it is not necessary to raise and lower the boot with every movement of the foot (because the skier relies on gravity to provide the forward or downward motion) prove heavy and bulky when adapted to in-line roller skating. When skating on a flat surface, the in-line roller skater must lift the boot with every stride to provide a forward impetus, and a heavy upper shoe portion causes fatigue and reduces skating enjoyment.

Alternative modes of providing both comfort and adequate support for in-line roller skating have been suggested. Specifically, U.S. Pat. Nos. 3,963,252, 4,418,929, and 5,069,462 show roller skate frames that include a platform adapted to allow the skater to wear a conventional street shoe that is inserted into a series of braces and supports. These skates offer alternative shoe and frame designs to the rigid plastic outer shell and inner liner of the conventional in-line roller skate. However, significant problems exist with such designs in that the adjustable braces and supports of these designs, while needed to accommodate numerous shoe sizes and shapes, are bulky and uncomfortable. Additionally, there is a limited range of shoe types that the skates will accommodate, and thus, there is the additional requirement that the skater have the proper shoe type to properly utilize the skate.

Because speed beyond that of conventional skating is associated with in-line roller skating, there is a further need for speed control systems on in-line roller skates. Prior solutions to speed control include the placement of bumpers or friction pads on the front or rear of at least one of the skates, allowing the skater to tip or lift his or her foot, either forward or rearward, to bring the bumper into contact with the skating surface. Accordingly, the skater drags the bumper along until he or she has slowed to a desired speed. While this system has proven satisfactory for paired wheel roller skates using pairs of wheels in a side-by-side configuration as the support base, the narrow lateral support base of in-line roller skates makes this breaking maneuver difficult. Accordingly, speed control on in-line roller skates employing this type of drag brake requires a high level of skill and coordination to be performed properly. Higher speeds make it difficult for the skater to raise or remove the weight from one foot to properly position the bumper for contact with the skating surface.

U.S. Pat. No. 5,067,736 shows a conventional brake adapted for use in in-line roller skating. A pad is retained in a brake housing, the housing being securely fastened to the lower frame portion of the in-line roller skate. Other patents, specifically U.S. Pat. Nos. 5,052,701 and 5,028,058, disclose similar braking pads having different configurations mounted on the rear of in-line roller skates. However, in all of these designs, it is necessary for the skater to maneuver or reposition at least one of his feet to properly apply the brake.

Some alternative braking methods have been proposed that apply friction plates or pads to the wheels of the in-line roller skate. U.S. Pat. No. 5,171,032 suggests a method of braking by horizontally forcing one or more plates against the in-line roller skate wheel(s). The plates are actuated by a hand control 80, causing brake pads 40 to move substantially horizontally toward in-line roller skate wheel(s) 98.

Braking apparatus used on in-line roller skates must be configured to minimize possible damage to the braking system caused by the user falling or bringing the skate into contact with fixed objects. The design must further avoid debris from becoming jammed in the brake, causing the brake to fail to function and thereby failing to control the skater's speed. More importantly, the brake must be designed to avoid inadvertently jamming against the wheel (s) during skating. It is thus important to position the braking apparatus within the lower frame portion of the in-line roller skate to protect the moving parts of the brake from debris or from being damaged due to impacts.

Another problem with prior art designs for in-line skates involves the need to be able to quickly and easily replace wheels as they become worn. Most current systems require major disassembly of either the lower frame portion or the wheel and mounting axle structure in order to replace a wheel. In this regard, there is a long-felt need for a method of readily replacing or interchanging in-line roller wheels.

SUMMARY OF THE INVENTION

In accordance with the present invention, an in-line roller skate is disclosed having a comfortable and soft, pliable, breathable shoe portion including a base and an ankle support cuff. The shoe portion may incorporate strategically placed rigid and semi-rigid structures to provide needed support for the skater's foot. The structures may comprise a heel counter integral with the soft, pliable, breathable shoe portion or be attached to the base portion for connection to the soft, upper portion of the shoe. Further included in the preferred embodiment of the invention is an ankle support cuff hingedly attached to the internal or external heel counter. Arch, heel, and ball supports for the foot may also be provided within the shoe portion, specifically the base portion, to improve the support and comfort of the in-line roller skate.

The ankle support cuff is adjustably attached to the heel counter to provide both lateral and longitudinal adjustment of the ankle support cuff with respect to the base portion. The base portion may be provided with means for attachment to a lower frame portion, generally supporting a plurality of wheels rotatable in a common plane of rotation. The attachment means of the base to the lower frame portion may allow both lateral and longitudinal movement of the upper shoe portion with respect to the lower frame portion. Alternatively the base and lower frame portion may be a single molded unit.

The present invention may also include a speed control, including a pressure plate above a minimum of one, but preferably two, of the in-line roller wheels. The pressure plate is biased away from the in-line roller wheels in a substantially vertical direction. Upon actuation of the speed control, the pressure plate is forced substantially downward until it contacts at least one in-line roller wheel. Actuation of the speed control can be accomplished using either a lever, or alternatively, by a cable actuating means.

Further included in the frame portion of the present invention are means for quickly releasing and replacing the in-line wheels, such as when worn or damaged.

The present invention departs from the teachings of the prior art by forming a substantial part of the upper shoe portion out of soft, pliable, breathable materials capable of transmitting air and heat directly therethrough, while also properly supporting the user's foot. The support is provided in a few critical areas, such as the ankle and heel of the user's foot, using rigid materials. Semi-rigid materials may also be used in some support portions. In particular, the upper shoe portion of the present invention comprises a soft, pliable, breathable shoe material in combination with a rigid or semi-rigid base portion and ankle support cuff. As a result, the body of the upper shoe portion is comfortable for a skater to wear while the base portion and ankle support cuff of the upper shoe portion provide the support needed to allow a skater to easily maintain the in-line roller skate wheels oriented vertically on their roller surfaces while skating.

The term "rigid" with respect to the present invention means a plastic material highly resistant to bending or flexing, while "semi-rigid" means that the material, while capable of resisting a substantial deforming force, is also able to bend or be temporarily deformed by a force somewhat greater than the normal force encountered in use. "Heat moldable" refers to both rigid and semi-rigid plastic materials that become reasonably pliable and formable at a higher temperature than would customarily be associated with in-line roller skating.

In general, a combination of heat moldable "rigid" and "semi-rigid" plastic materials are used in combination with soft, pliable breathable materials, in an in-line roller skate, to provide greater comfort, without foregoing the support that has previously been achieved using "rigid" materials. It will be understood that the terms "rigid" and "semi-rigid" may thus refer not only to the type or hardness of material used in the in-line roller skate, but also to the thickness of the material. Similarly, the terms "non-rigid," "soft," and "pliable" describe materials such as leather, cloth or mesh fabrics of various densities that have a certain flexibility and "give" to them as compared to a rigid or semi-rigid material and thus are more comfortable for a skater when placed adjacent a skater's foot. The term "breathable" refers to a material through which air can readily pass and is distinguished from molded plastic materials of either the rigid or semi-rigid type that are substantially impervious to air transmission or which simply provide ventilation ports for air circulation.

BRIEF DESCRIPTION OF THE DRAWINGS

The foregoing aspects and the attendant advantages of this invention will be more readily appreciated as the same become better understood by reference to the following detailed description, when taken in conjunction with the accompanying drawings, wherein:

FIG. 2A is a perspective view of one embodiment of the footbed portion of the present invention, illustrating the lip supports and the heel counter;

FIG. 3A is a sectional side view of the footbed portion of FIG. 2A of the present invention, including the heel counter, raised support lips, and the frame mounting means;

DETAILED DESCRIPTION OF THE PREFERRED EMBODIMENT

While the preferred embodiment of the invention has been illustrated and described, it will be appreciated that various changes can be made therein without departing from the spirit and scope of the invention.

Figure 1:
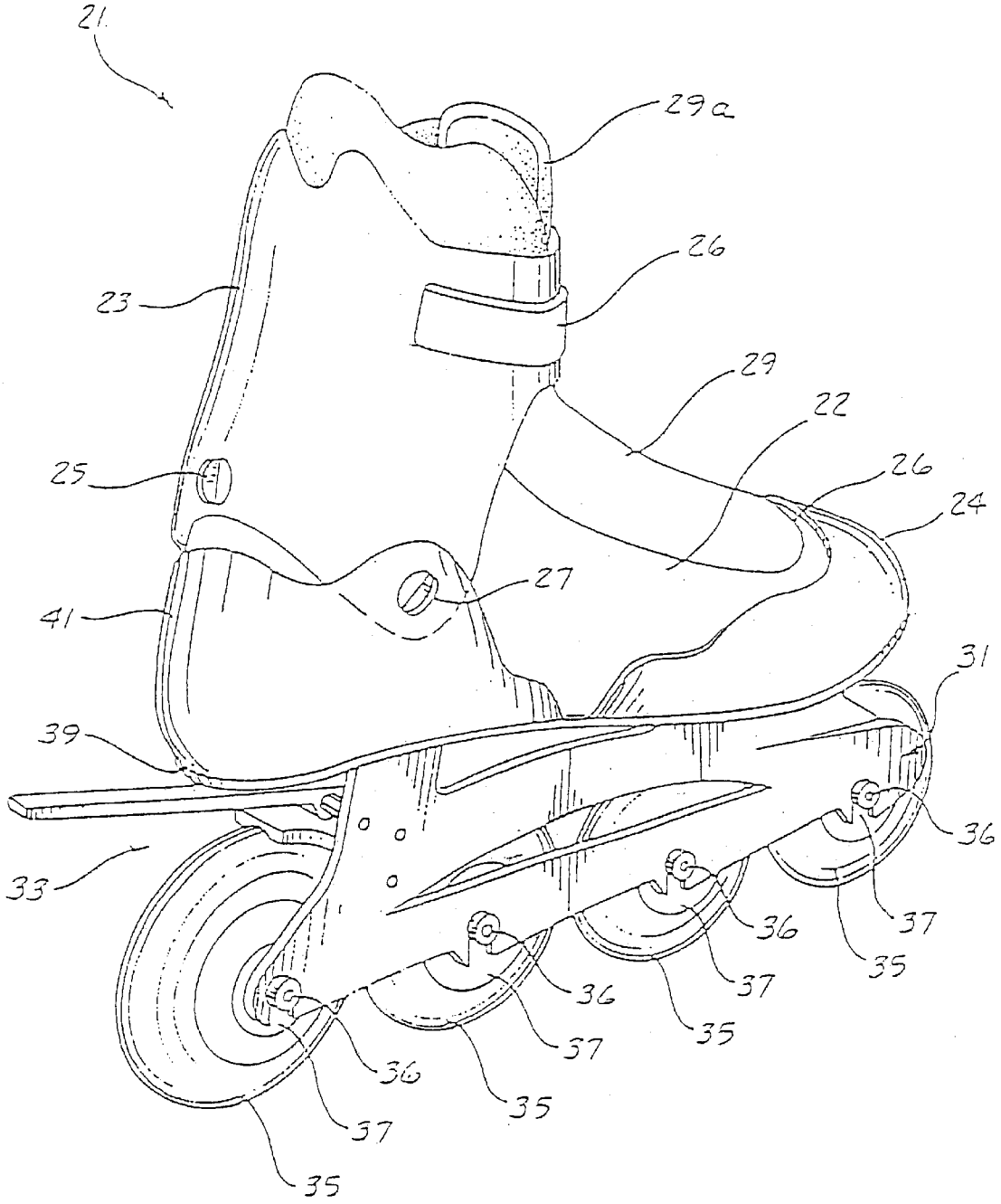
FIG. 1 is a perspective view of one embodiment of the present invention, illustrating the soft, pliable, breathable shoe portion and semi-rigid ankle support cuff attached to the lower frame portion of the present invention.

Referring to FIG. 1, an in-line roller skate 21 made according to the present invention is disclosed. The in-line roller skate 21 includes a soft, pliable, breathable shoe portion 22, which is preferably made of breathable materials of the type commonly used in running shoes. Leather or leather-like man-made materials may be used, as may cloth fabrics and mesh fabric materials. Since the principal physical support for the skater's foot in the present invention is provided by strategically positioned support members, including an exterior ankle support cuff 23 and a base portion 39 to be described hereafter, the materials used to construct the shoe portion 22 are chosen for comfort, breathability, and heat transmissibility to cool the skater's foot. For purposes of describing the present invention, the shoe portion 22, the base portion 39, and the ankle support cuff 23 together form what is referred to as the entire upper shoe portion.

The in-line roller skate 21 of the present invention includes a base portion 39, a heel counter 41, a soft, pliable, breathable shoe portion 22, which in one embodiment includes a rigid or semi-rigid toe portion 24, and an ankle support cuff 23 having a conventional securing strap 26. While the preferred embodiments will be discussed in detail below, it is understood that the shoe portion 22 may integrally include both the toe portion 24 and the heel counter 41. The heel counter 41 and/or the toe portion 24 may be laminated externally of the shoe portion 22 or be integrally contained within the shoe portion 22. Alternatively, the heel counter 41 and/or the toe portion 24 may both be an integral part of the base portion 39 or one or the other may be attached to the base portion 39 while the other is attached to the shoe portion 22. The material comprising the heel counter 41 and the toe portion 24 may be rigid or semi-rigid materials, depending on the intended use of the in-line roller skate 21 and the desired degree of support.

In-line roller skate 21 further includes an external ankle support cuff 23 having a conventional securing strap 26. The ankle support cuff 23 is shown hingedly mounted on the heel counter 41. Although it will be understood that the ankle support cuff 23, which is made of either rigid or semi-rigid material, can likewise be an integral part of the soft, pliable, breathable shoe portion 22, the preferred embodiment of the present invention mounts the ankle support cuff 23 internally and hingedly to the heel counter 41. The ankle support cuff 23 can, alternatively, be externally mounted to the heel counter 41. It will also be understood that heel counter 41 can itself be an integral part of the soft boot or an external counter bonded to the soft boot. The ankle support cuff 23 can include both longitudinal canting means 25 and lateral canting means 27, which will be described in detail hereafter.

Figure 16A:
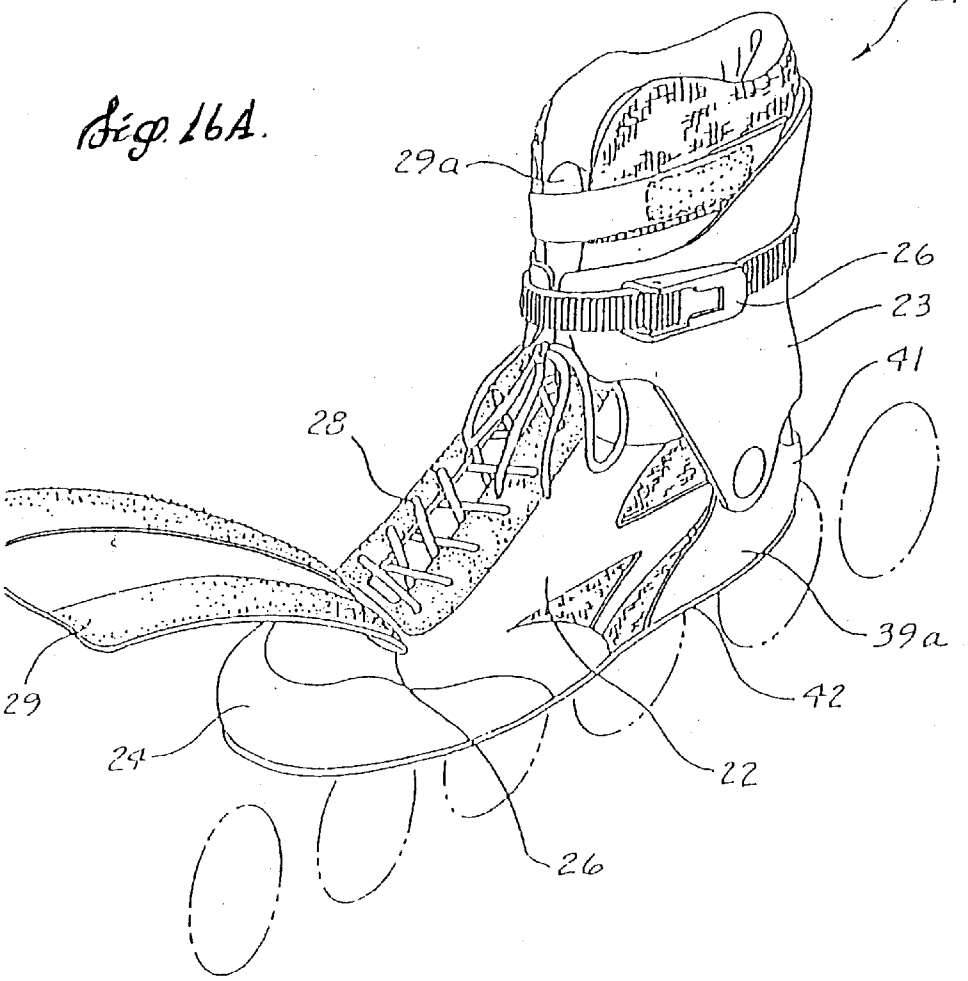
FIG. 16A is a front perspective view of one embodiment of the present invention, illustrating the soft, pliable, breathable shoe portion, an external lace cover, and the semi-rigid ankle support cuff and securing strap attached to a lower frame portion.

FIG. 1 discloses an external lace cover 29, which may be integrally connected to the soft, pliable, breathable shoe portion 22 at its base 26 so that the lace cover can be pivoted forwardly to allow easy access to the shoe laces and the interior of the shoe. Referring also to FIG. 16A, conventional shoe laces 28 may be provided inward of the lace cover 29. Internal tongue 29*a* is provided to prevent the laces 28 from bearing directly on the skater's foot.

Also illustrated in FIG. 1 is a lower frame portion 31 which is typically formed of injection molded plastic or metal and a speed control 33, which will be described in detail hereafter. The lower frame portion 31 may alternatively be made of fiberglass with an epoxy resin or graphite with an epoxy resin. A plurality of in-line roller wheels 35 are mounted on axle means 36 that will also be described in detail hereafter. The in-line roller wheels 35 are mounted for rotation in a common longitudinal plane. Axle means 36 are shown fitted in upwardly extending notches 37 in lower frame portion 31 in a manner such that wheels 35 can be easily replaced or interchanged when worn. While the notches 37 are shown for purposes of describing the present invention, it will be understood that a variety of methods of mounting the in-line roller wheels 35 can be used, including mounting methods that allow variation in the vertical positioning of the axes of rotation of the in-line roller wheels 35.

FIGS. 2A and 3A illustrate the base portion 39 made in accordance with the present invention. The base portion 39 can be a relatively simple flat sole or a relatively complex contoured sole containing supports and attachment means. For purposes of the present description, the base portion 39 will be described in its more complex form, it being understood that not all of the supports or attachments described hereafter need be included in every embodiment of the present invention. Referring to FIGS. 2A and 3A, the base portion 39 includes a sole portion 40, an integrally connected heel counter 41 for cupping the back of the skater's heel, and raised support lip 43 on the sides of the base portion 39 in the area of the ball of the skater's foot. In a preferred embodiment, the sole portion 40 has an upper surface and a lower surface. The upper portion of the sole portion 40 may be anatomically fitted to the user's foot by molding or other known techniques as described hereafter, to evenly distribute pressure along the bottom of the foot. The heel counter 41, and the raised support lips 43 provide support to aid the skater in maintaining the in-line roller skate in a substantially vertical position. The lower portion of the sole portion 40 provides an interface for mounting the upper shoe portion onto the lower frame portion where the upper shoe portion and the lower frame portion are separate units. Because in this invention much of the upper shoe portion is formed of soft, pliable, breathable material, the footbed portion, and other supports, including primarily the ankle support cuff 23, provide substantially all of the needed support and stability for the skater's foot.

The sole portion 40 of the base portion 39 may include an arch support portion 45, a heel support 47, and a ball support 49. The supports 45, 47, and 49 contour the base portion 39 to the user's foot and are preferably made of a heat moldable plastic integrally mounted in the sole portion 40 of the footbed portion 39. The use of heat moldable plastic enables a skater to heat the moldable plastic supports 45, 47, and 49 by conventional means, such as a hair dryer, to a temperature sufficient to cause them to become pliable. The footbed portion 39 can then be anatomically fitted to the skater's foot by placing the foot therein and allowing the heat moldable plastic to cool and harden in a shape conforming to the skater's foot. The plastic supports 45, 47, and 49 may be included as desired or required depending on skate design criteria and the form of the mounting means contained within the base portion 39.

The heel counter 41 and the raised support lips 43 may also be fabricated from heat moldable plastics. As with the supports 45, 47, and 49, the heel counter 41 and the raised support lip 43 can be anatomically fitted to the user's foot using a conventional hot air heat source. The base portion 39 of the present invention can thus be formed to fit the user's foot, thereby minimizing unwanted movement of the skater's foot within the upper shoe portion while simultaneously improving the overall comfort of the upper shoe portion.

While FIGS. 2A and 3A show the heel counter 41 as an integral part of the base portion 39, other embodiments of the present invention may integrally mount the heel counter 41 in the soft shoe portion 22, while the base portion 39 would primarily comprise sole portion 40. Alternatively, the base portion 39 could contain an additional heel counter portion such that the shoe portion 22, and the integral heel counter 41, are laminated thereto in a known fashion.

Figure 16B:
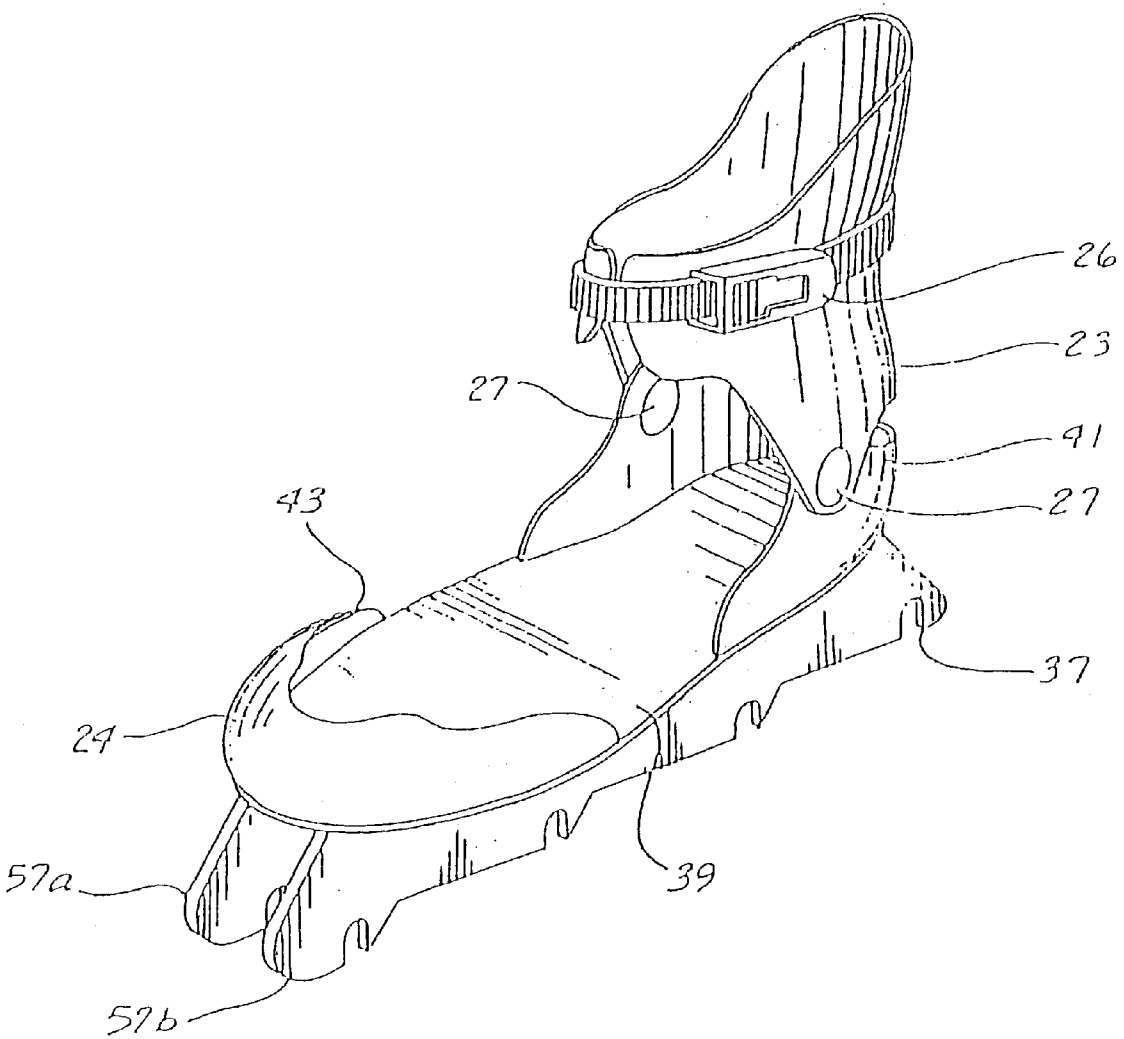
FIG. 16B is a partial perspective view of the present invention illustrating an alternative embodiment having the footbed portion and lower frame portion combined as a single injection molded unit.

Again referring to FIGS. 2A and 3A, the sole portion 40 of base portion 39 is shown to include a pair of front mounting means 51*a* and at least one identical rear mounting means 51*b*. Mounting means 51*a* and 51*b* are adapted to allow the upper shoe portion to be mounted to the lower frame portion 31 in a manner such that the upper shoe portion may be moved both laterally and longitudinally with respect to the lower 31 frame as desired by the user. In particular, mounting means 51*a* and 51*b* each include a plate 53 having a threaded opening 54*a* formed therein and adapted to receive a complementary threaded fastener such as 54*b* (FIG. 3A), which is sized to extend upwardly through a portion of the lower frame portion 31. Each plate 53 is mounted in an oversize cavity 54*c* formed in the sole portion 40 such that the plate 53 can move both laterally and longitudinally within the cavity 54*c* when the fastener 54*b* is loosened in the threaded opening 54*a*. When the skater adjusts the position of the upper shoe portion to its desired location with respect to the lower frame portion 31, the fasteners 54*b* are tightened to hold the upper shoe portion in position. While it is preferred that the upper shoe portion be both laterally and longitudinally adjustable with respect to the lower frame portion 31, it will be understood that the base portion 39 can be permanently fastened to the lower frame portion 31 using conventional fastening means, such as rivets. In addition, the base portion 39 and the lower frame portion 31 can be integrally combined in a single injection molded unit such as shown in FIG. 16B. This embodiment would not allow adjustment of the upper shoe portion with respect to the lower frame portion 31, but would provide substantial desired rigidity and strength between the upper shoe portion and the lower frame portion 31.

Figure 2B:
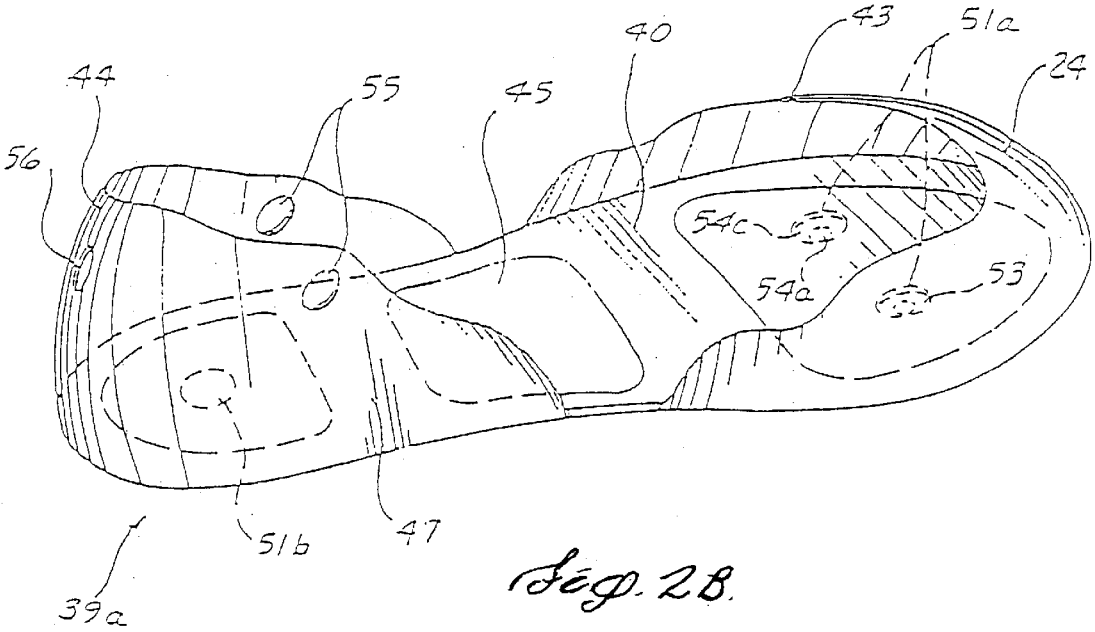
FIG. 2B is a perspective view of another embodiment of the footbed portion of the present invention, illustrating a modified toe portion.
Figure 3B:
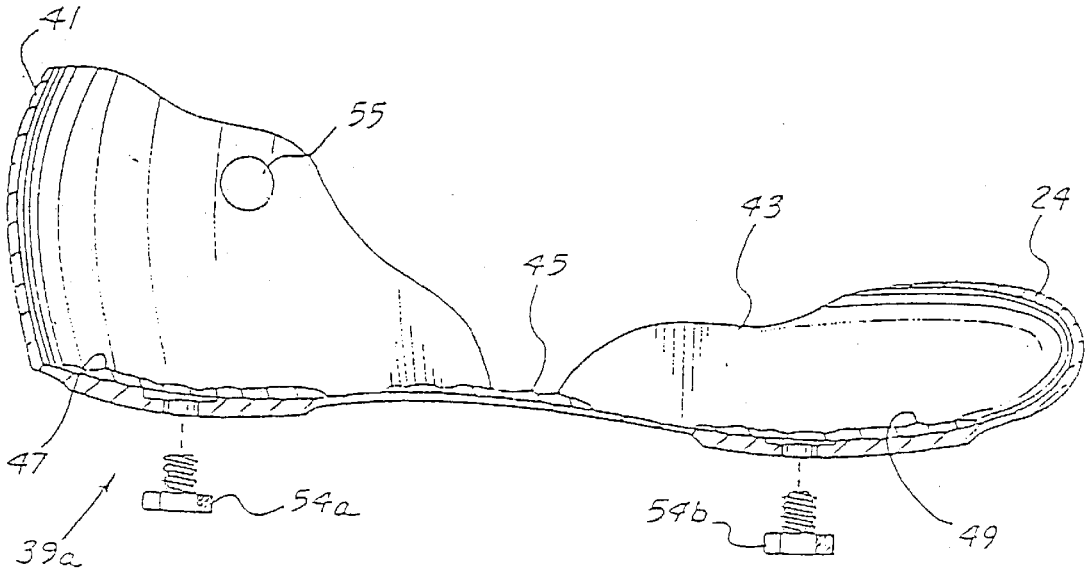
FIG. 3B is a sectional side view of the footbed portion of FIG. 3A of the present invention, including the heel counter, toe portion, and frame mounting means.

Referring to FIGS. 2B and 3B, an alternate form of base portion 39*a* of the present invention is disclosed, without the raised support lips 43, but including a toe portion 24. In this embodiment, the soft, pliable, breathable shoe portion 22 may be laminated to the base portion 39 as such that toe portion 24 provides additional laminating surface adding support and strength to the shoe portion 22. In addition, the toe portion 24 can be extended rearward sufficiently to provide the earlier described support function of lips 43. The durable, semi-rigid toe portion 24 further prevents the soft pliable material comprising the shoe portion 22 from damage caused by scuffing the toe, or by the toe of the in-line roller skate 21 bumping or scraping the road surface or other objects.

Figure 4:
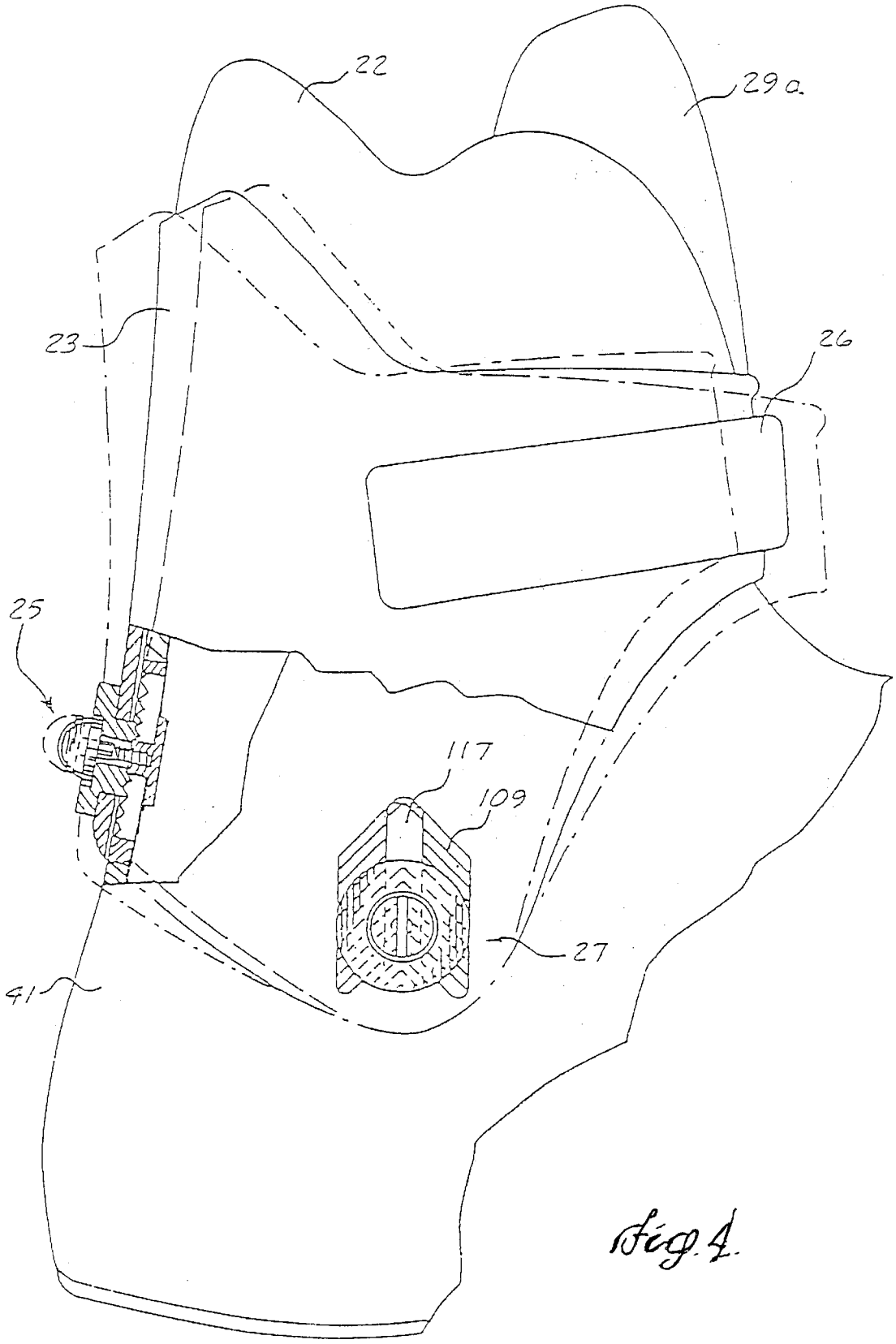
FIG. 4 is a side elevational view of the present invention, illustrating the ankle support cuff, the ankle support cuff canting means in section, and alternate longitudinal canting positions of the ankle support cuff.
Figure 5:
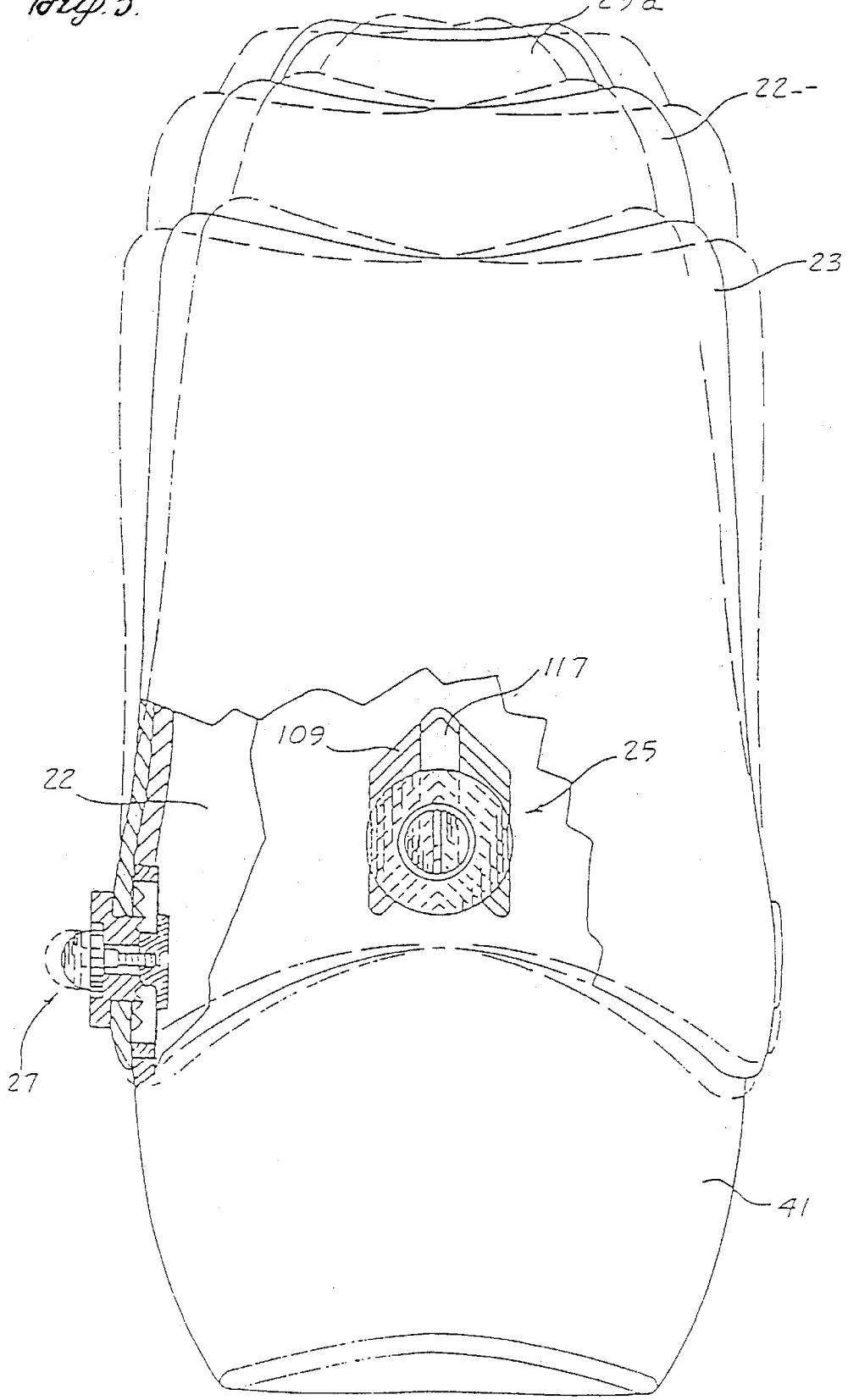
FIG. 5 is a rear elevational view of the present invention, illustrating the ankle support cuff and ankle support cuff adjustment means in section and alternative lateral canting positions of the ankle support cuff.

FIGS. 4 and 5 illustrate an ankle support cuff 23 made according to the present invention. The ankle support cuff 23 is secured to the heel counter 41 through lateral support apertures 55 and longitudinal support aperture 56 (shown in FIGS. 2A and 2B) in a manner to be described hereafter. In one embodiment, the ankle support cuff 23 can be rigidly fixed to the heel counter 41, allowing very limited flex of the ankle support cuff 23 with respect to the footbed portion 39 and the lower frame portion 31. In this mode, the in-line roller skate becomes a substantially rigid unit with no longitudinal or lateral adjustment and flexibility is limited to that produced by the flex of the materials comprising the ankle support cuff 23, the heel counter 41, and base portion 39. As a means of controlling flexibility, the material used in the fabrication of the ankle support cuff 23 can be selected for its characteristic flexibility, which may range from very rigid to a pliable, but semi-rigid material.

In an alternative embodiment, ankle support cuff 23 can be hingedly attached to the heel counter 41 through lateral support apertures 55, thus allowing forward and rearward pivotal movement of the ankle support cuff 23. As discussed earlier, the heel counter 41 can either be an integral part of the base portion 39 or of the shoe portion 22. Hinging of the cuff allows the skater to flex his ankle forward and rearward with ease, while providing considerable rigidity in the lateral direction. In still another embodiment of the present invention, the ankle support cuff 23 is adjustable both longitudinally (FIG. 4) and laterally (FIG. 5) as described more fully hereafter.

The ankle support cuff 23, in combination with the base portion 39 and the heel counter 41, support the skater's ankle and foot and assist the skater in maintaining a substantially upright ankle position. The ankle support cuff 23 is preferably made of a semi-rigid plastic and may be made of a heat moldable plastic similar to the heat moldable plastics described above with respect to the footbed supports 45, 47, and 49. As with the heat moldable plastics in the base portion 39, the heat moldable plastic ankle support cuff 23 can also be heated with hot air and formed for a better fit.

In-line roller skating requires substantial shoe support in combination with the strength, coordination and agility of the skater to maintain the in-line roller skate in a near vertical position. The various support components of the present invention described heretofore, including the ankle support cuff 23, the heel counter 41, and the base portion 39, provide the needed support, thus allowing soft, pliable, breathable shoe portion 22 to be made of material such as leather, mesh fabric or the like, to enhance the comfort of the in-line roller skate. It will be understood that any of the known materials commonly used in running shoes to provide comfort and to dissipate heat by allowing air circulation about the user's foot can be used in the present invention to accomplish the goal of providing a comfortable, cool, in-line roller skate whose principal foot support comes from strategically placed support structures rather than from a rigid molded boot.

The ankle support cuff 23 of the present invention may include a canting system for lateral and longitudinal tilt adjustments. In general, the preferred embodiment of the canting system comprises two movable parts, each respectively associated with either the ankle support cuff 23 or the heel counter 41 and capable of being securely locked together. As will be described hereafter, a skater wishing to tilt the ankle support cuff longitudinally or laterally loosens the longitudinal canting means 25 or the lateral canting means 27 and moves the two parts with respect to one another to position the ankle support cuff 23 according to the skater's preference. It will be readily apparent to those skilled in the art that the lateral canting means 27 can be placed on either the inside or the outside of the ankle supporting cuff 23. Phantom views in FIG. 4 show the support cuff 23 adjusted to various longitudinally canted positions, while in FIG. 5, the phantom views show the ankle support cuff 23 adjusted to various laterally canted positions as desired by the skater.

As can be seen from FIGS. 1 and 16A, the soft, pliable, breathable shoe portion 22 substantially surrounds the skater's foot and extends above the ankle support cuff 23. The extension of the shoe portion 22 above the ankle support cuff 23 prevents the upper portion of the semi-rigid ankle support cuff 23 from uncomfortably binding against the skater's ankle or calf. In a similar fashion, the internal tongue 29*a* also extends above the ankle support cuff 23 to prevent the ankle support cuff 23 from binding against the skater's shin when substantial longitudinal forward force is applied against the ankle support cuff 23 and securing strap 26.

Figure 6:
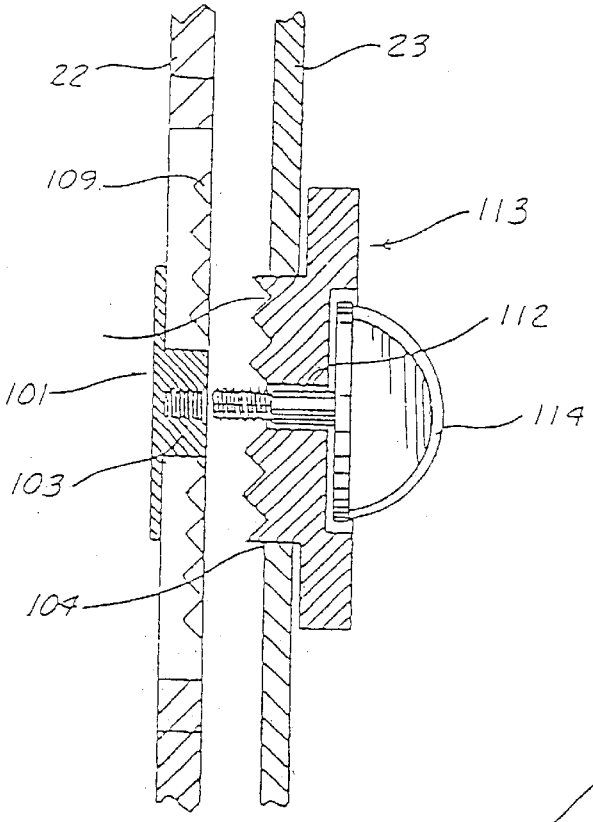
FIG. 6 is a side sectional view of the ankle support cuff adjustment means.
Figure 7:
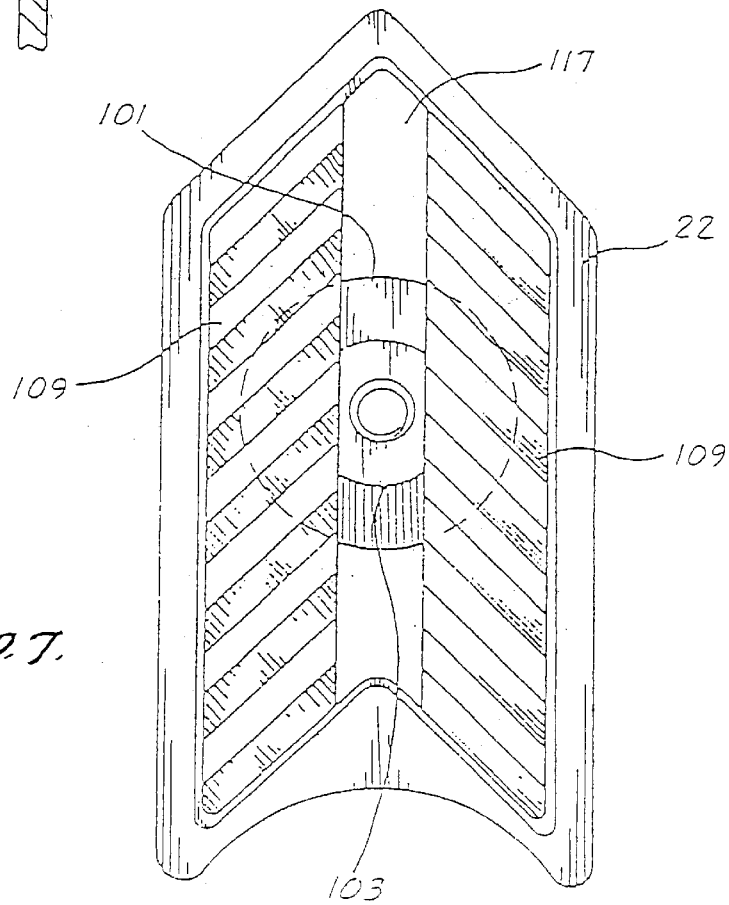
FIG. 7 is a diagrammatic plan view of the ankle support cuff adjustment means.

Referring now to FIGS. 6 and 7, the longitudinal and lateral canting mechanisms of the present invention are disclosed in detail. In a preferred embodiment, the canting mechanism includes a cap nut 101 mounted to or within the heel counter 41 such that its internally threaded barrel 103 extends into a slot 117 in the heel counter 41. The outer surface of the heel counter 41 in the region adjacent the slot 117 includes a plurality of surface grooves 109 arranged on opposite sides of the slot, so that the grooves on one side of the slot are angled relative to those on the opposite side in a chevron-like configuration. The ankle support cuff 23 includes an opening 104 outwardly adjacent the internally threaded barrel 103 into which is inserted a plug 111 having surface grooves 113 sized and configured to engage the surface grooves 109. The plug 111 includes a central opening 112 into which is inserted a cap screw 114 threaded to engage the internally threaded barrel 103 of the cap nut 101. It will be understood that tightening of the cap screw 114 relative to the cap nut 101 causes the cooperating grooves 109 and 113 on the heel counter 41 and the plug 111, respectively, to engage each other, to fix the position of the ankle support cuff 23 with respect to the base portion 39. When the cap screw 114 is loosened, the grooves 109 and 113 can be disengaged, and the cap nut 101 can be moved within the slot 117 to allow the ankle support cuff 23 to be canted relative to the base portion 39.

Figure 8:
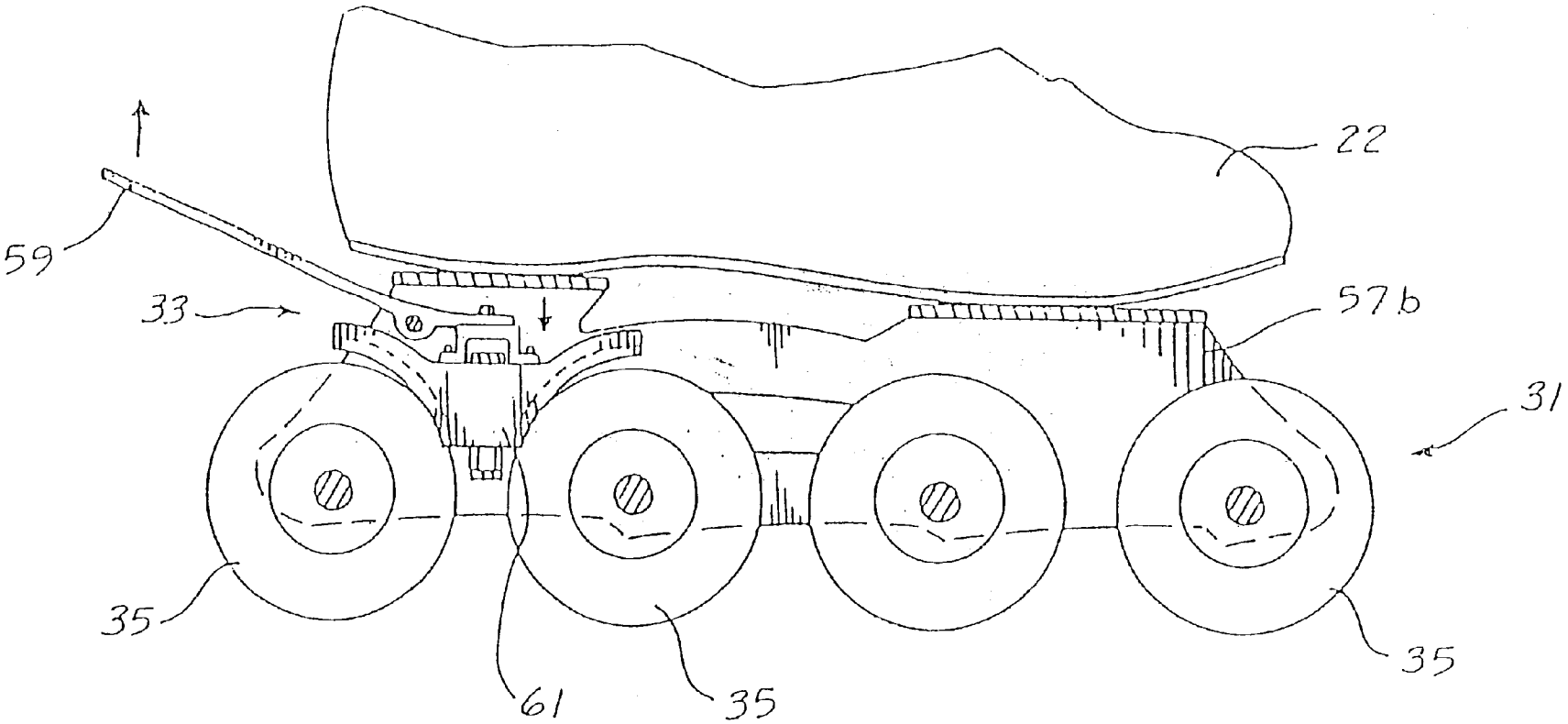
FIG. 8 is a diagrammatic side elevational view of the lower frame portion of the present invention, including a speed control means.

Referring now to FIG. 8, one embodiment of the lower frame portion 31 of the present invention is disclosed. The lower frame portion 31 comprises a frame rail 57*b*, which preferably includes notches 37 (shown in FIG. 1) in which the axle means 36 are held to allow in-line wheels 35 to be easily interchanged or replaced. While the notches 37 are shown for purposes of describing the present invention, it will be understood that a variety of methods for mounting the in-line wheels 35 can be used, including mounting methods that allow vertical adjustments of the axis of rotation of the plurality of in-line wheels 35. The in-line wheels 35 are mounted to be rotatable in a common longitudinal plane of rotation. The lower frame portion 31 further includes a brake or speed control 33 having an actuating lever 59. In use, a skater reaches down and pulls upward on the actuating lever 59 forcing contoured speed control plate 61 to bear against the in-line roller wheels 35. Alternatively, those skilled in the art will recognize that the actuating lever 59 may be arranged and configured such that in use speed control plate 61 bears against the in-line roller wheels 35 by pushing down on actuating lever 59. This mechanism is discussed in further detail hereafter. In a preferred embodiment of the present invention, the contoured speed control plate 61 contacts a minimum of two wheels, typically the two rearmost wheels on the in-line roller skate. However, those skilled in the art will readily recognize that the contoured speed control plate 61 may contact from as few as one in-line roller wheel 35 to as many as all of the in-line wheels 35 mounted on the lower frame portion 31.

Figure 9:
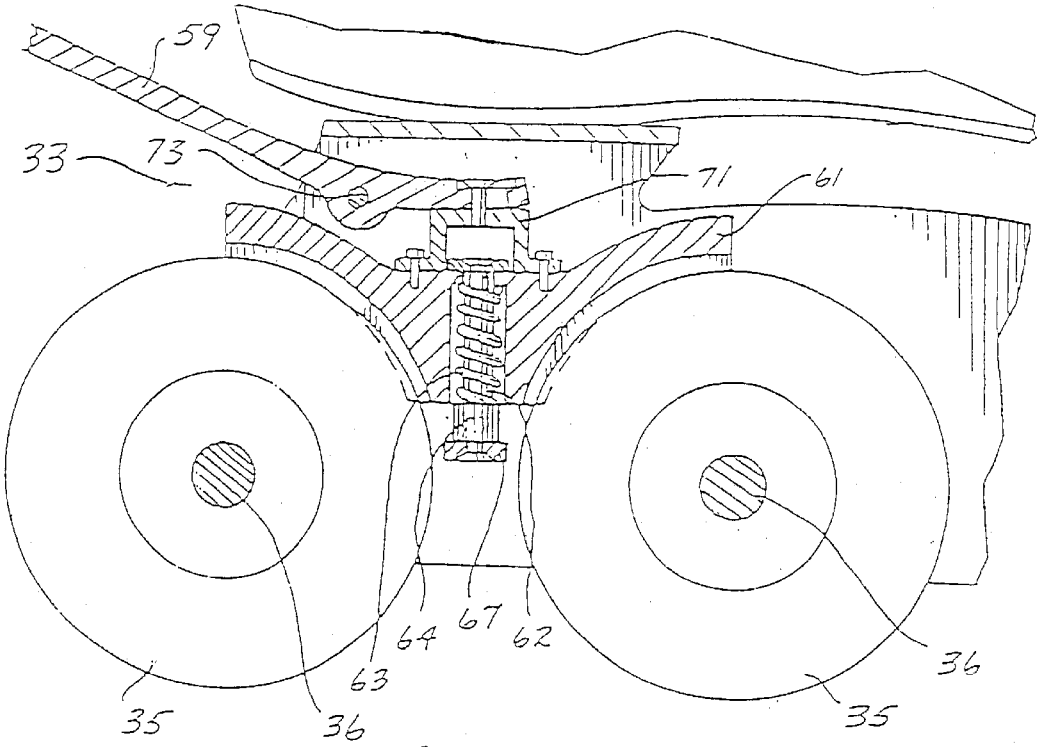
FIGS. 9 and 10 are diagrammatic partial side sectional views illustrating a speed control means made in accord with the present invention and showing the speed control mean in its non-braking and braking modes, respectively.
Figure 10:
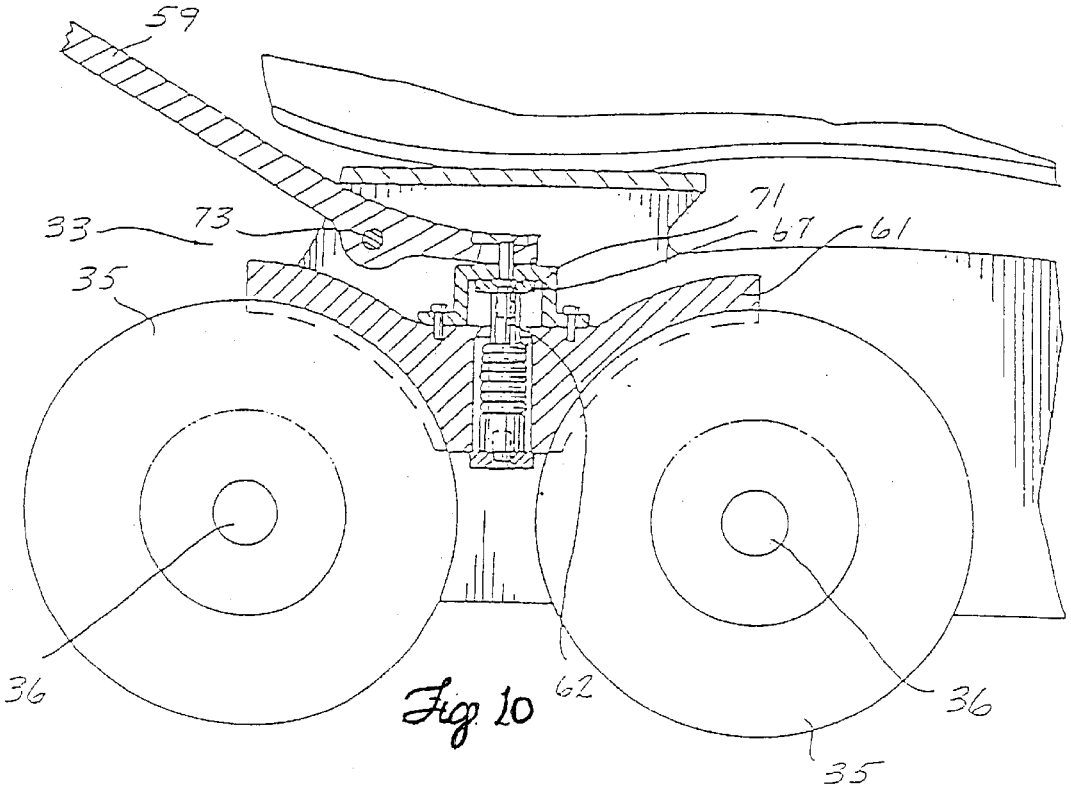

FIGS. 9 and 10 show the speed control means 33 of FIG. 8 in longitudinal cross section in its unactuated and actuated or braking positions respectively. The contoured speed control plate 61 is movable on a vertical shaft 62 in a substantially vertical direction, toward and away from the in-line roller wheels 35. A biasing spring 63 acts to bias the contoured speed control plate 61 away from the in-line roller wheels 35. When a force overriding the biasing spring 63 is applied to the actuating lever 59, the contoured speed control plate 61 moves in a downward direction to contact the in-line wheels 35. Contact between the speed control plate 61 and the in-line wheels 35 creates friction sufficient to impose a drag on the in-line roller wheels 35, thus slowing or stopping the rotation of the wheels thereby controlling the speed of the skater. Varying the force applied to the actuating lever 59 varies the drag on the in-line roller wheels 35. It will be understood that application of a selected force will slow but not necessarily stop the in-line roller wheels 35 so that the skater's speed can be controlled, such as when descending a grade. The contoured speed control plate 61 can be made of any suitable material, including plastic or a metal such as aluminum.

Figure 12:
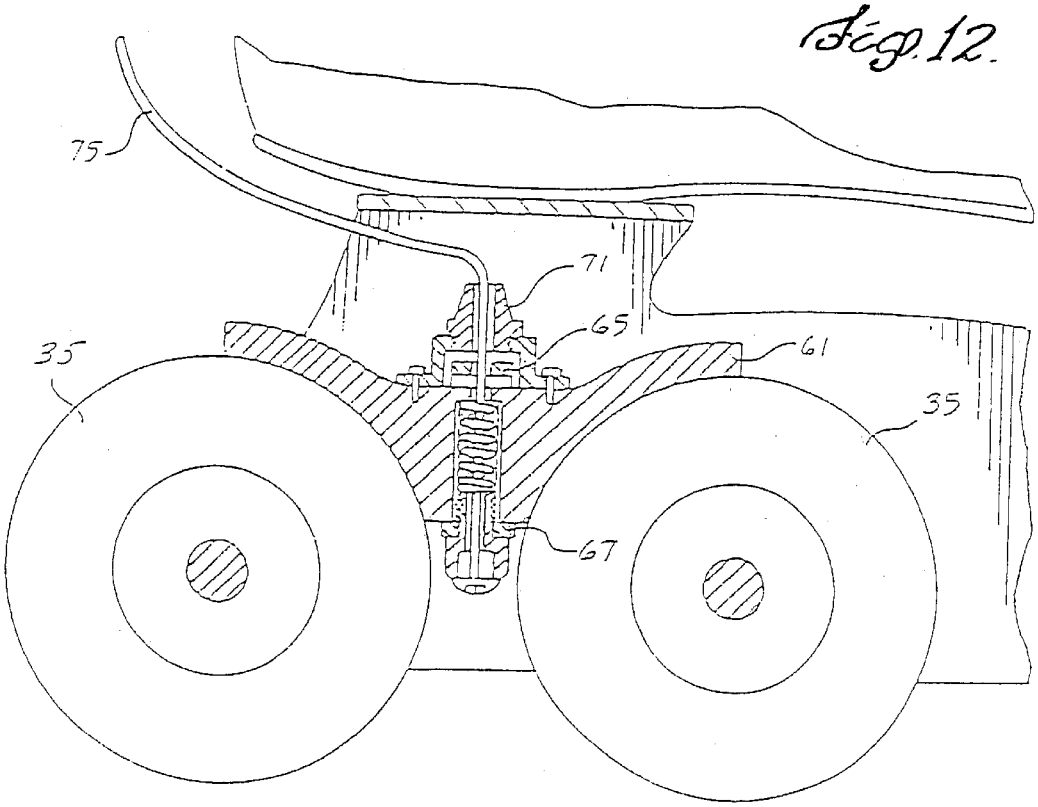
Figure 13:
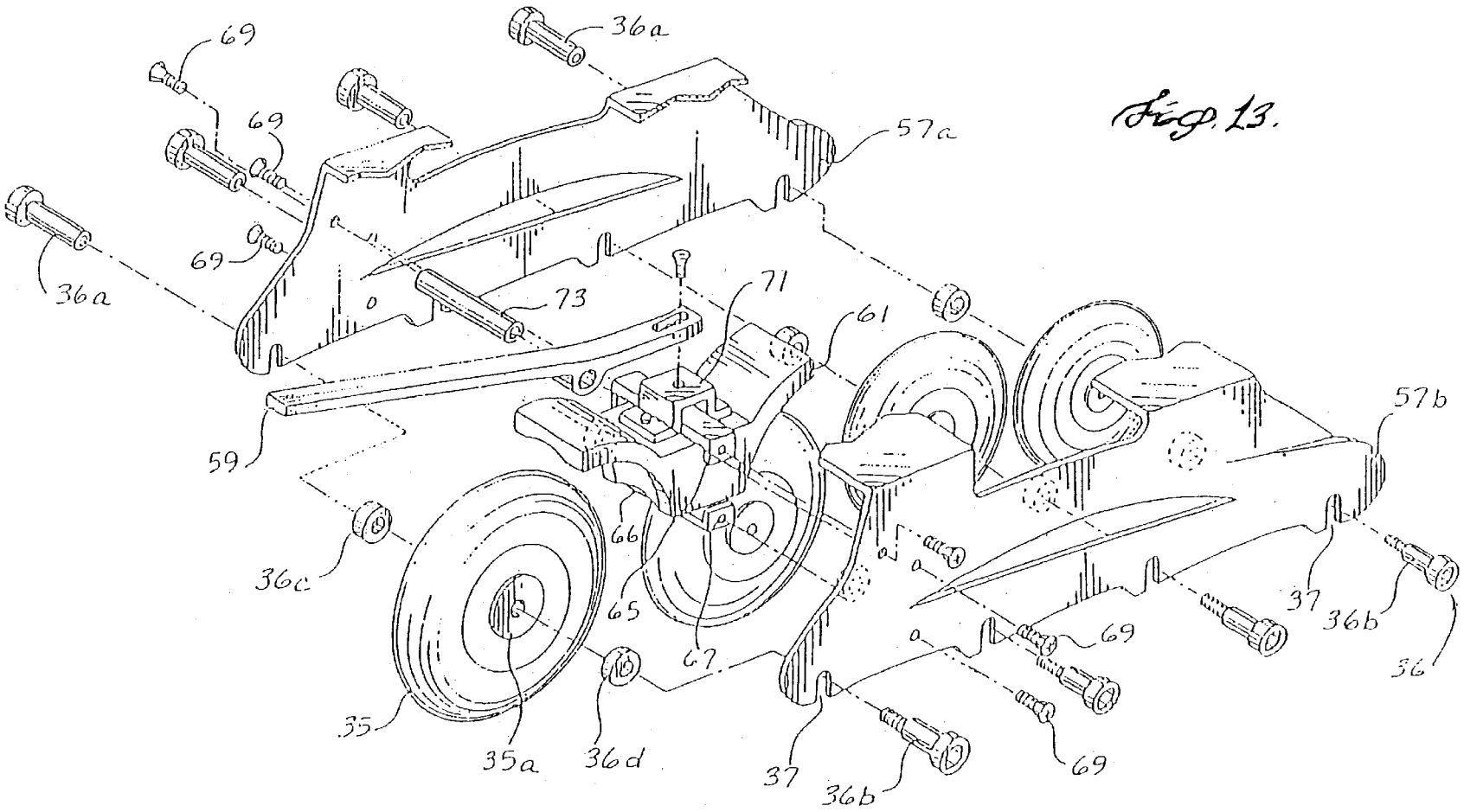
FIG. 13 is an exploded perspective view of the lower frame portion of one embodiment of the present invention.

Referring now to FIG. 13, there is shown an exploded view of the lower frame portion 31 of the present invention, including the speed control 33. The contoured speed control plate 61 is shown positioned between an upper mounting bracket 65 and a lower mounting bracket 67. The mounting brackets 65 and 67 are securely attached between frame rails 57*a* and 57*b* using appropriate fastening means, such as machine screws 69. The contoured speed control plate 61 is movable in a substantially vertical direction within the mounting brackets 65 and 67, from an uppermost position, such as that shown in FIGS. 9 and 11, to a lowermost position wherein the contoured speed control plate 61 contacts the in-line roller wheels 35, as shown in FIGS. 10 and 12.

The actuating lever 59 is mounted to pivot about a fulcrum pin 73, which is in turn mounted between the frame rails 57*a* and 57*b* by means of a fastener 69, and is attached at its inner end to a pressure plate 71. Accordingly, when the actuating lever 59 is raised, pressure is applied to the pressure plate 71 in a downward direction. The pressure plate 71, being directly connected to the contoured speed control plate 61, causes the contoured speed control plate 61 to move in a downward direction toward the lower mounting bracket 67. This downward movement results in contact of the contoured speed control plate 61 with the in-line roller wheels 35. The downward motion of the contoured speed control plate 61 is limited first, and preferably, by its contact with the in-line roller wheels 35. However, if the contoured speed control plate 61 continued to move in a downward direction, the biasing spring 63 would eventually become fully collapsed before the pressure plate 71 contacts the upper mounting bracket 65, and before a lower portion 66 of the contoured speed control plate 61 contacts the lower mounting bracket 67.

Figure 11:
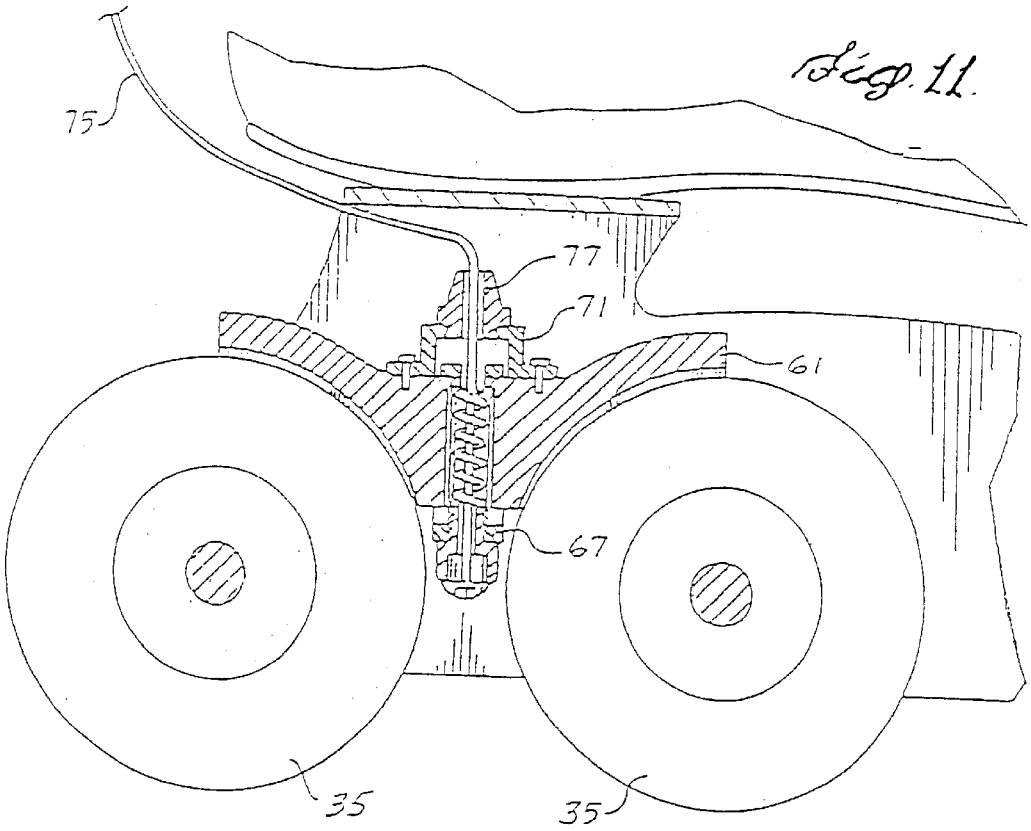
FIGS. 11 and 12 are diagrammatic partial side sectional views of a second embodiment of the speed control means of the present invention, illustrating a cable actuating means for the speed control.

FIGS. 11 and 12 show a second embodiment of the present invention wherein the actuating lever 59 is replaced with a cable 75. The biasing spring 63 again biases the contoured speed control plate 61 away from in-line roller wheels 35. When the cable 75 is pulled in an upwardly direction, a cable pressure housing 77 applies a downward force against the pressure plate 71, forcing the contoured speed control plate 61 to move in a downward direction toward the in-line roller wheels 35. In this embodiment of the present invention, the cable 75 uses as its anchoring member, the lower mounting bracket 67. Shortening of the cable 75 causes the distance between the pressure plate 71 and the lower mounting plate 67 to be reduced, thereby forcing the contoured speed control plate 61 downwardly. As with the earlier described embodiment of FIGS. 9 and 10, the cable 75 can apply force to the in-line roller wheels 35 as needed to control the speed of or bring the in-line wheels 35 to a stop. It will be understood that the cable 75 can run upwardly to the area of the skaters knee or belt where it can be easily grasped, or held in the skaters hands so that the skater can continuously apply speed control pressure as needed. A conventional handgrip can be attached to the cable to allow it to be more easily held and pressure applied by the skater. Alternatively, a cable or similar actuating means could be attached to the actuating lever 59 (in FIGS. 8–10), so that the skater could pull up on the cable to cause the end of actuating lever 59 to move upwardly, forcing the contoured speed control plate 61 against the in-line roller wheels 35.

FIG. 13 shows a conventional system for mounting the in-line wheels 35 within the frame rails 57*a* and 57*b*. In particular, an in-line roller wheel 35 is mounted on a bearing hub 35*a* having a central opening. The axle 36, which comprises an internally threaded cap nut 36*a* and a cooperating threaded cap screw 36*b*, extends through the frame rails 57*a* and 57*b*, spacer washers 36*c* and 36*d* on opposite sides of the in-line roller wheel 35, and through the opening in the bearing hub 35*a*. The internally threaded cap nut 36*a* and the cooperatingly threaded screw 36*b* are sized such that when the screw is fully threaded into the nut, an axle of uniform diameter is provided on which the in-line roller wheel 35 can rotate. The caps of the screw and nut grip the outer surfaces of the frame rails adjacent frame notches 37.

Figure 14:
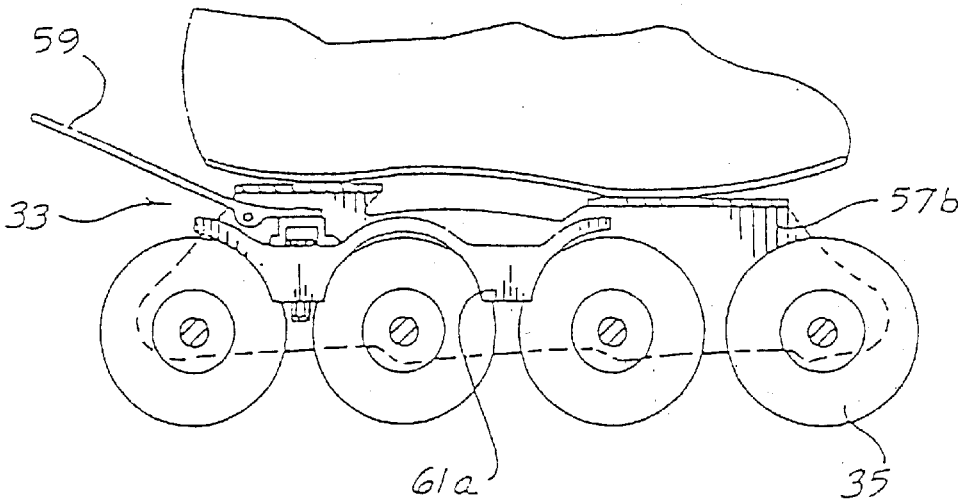
FIG. 14 is a diagrammatic side elevational view of an alternative embodiment of the speed control means of the present invention, wherein braking is applied to three of the four in-line roller wheels of the in-line roller skate.
Figure 15:
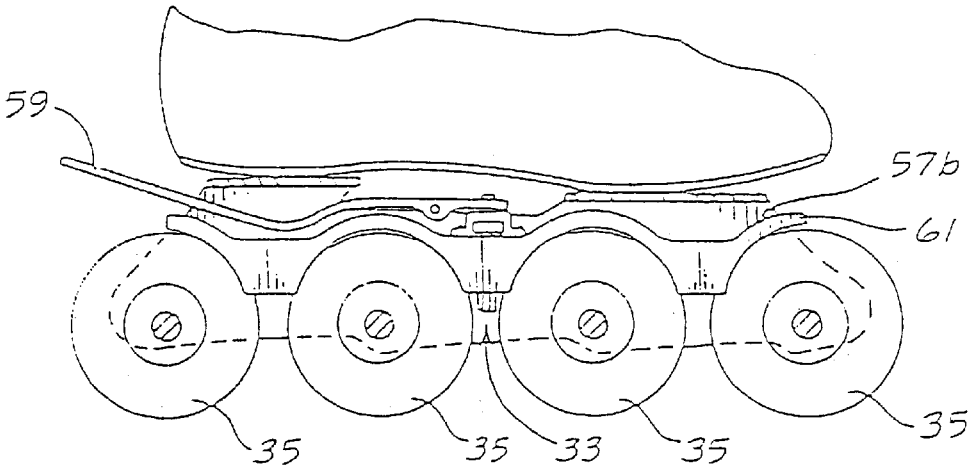
FIG. 15 is a diagrammatic side elevation view of still another alternate embodiment of the speed control means of the present invention, wherein braking is applied to all of the in-line roller wheels of an in-line roller skate.

Referring now to FIGS. 14 and 15, the contour speed control plate 61 of the present invention is shown shaped to apply drag to more than two of the in-line roller wheels 35. FIG. 14 shows an embodiment of a contoured speed control plate 61*a* as applied to three in-line roller wheels 35, and FIG. 15 shows an embodiment wherein the contour speed control plate 61 is applied to four in-line roller wheels 35. Accordingly, a skater using the actuating lever 59 can apply force to the in-line roller wheels 35 in the manner heretofore described as needed to control the speed or stop the in-line roller wheels 35. Alternatively, a cable such as 75 can be used to apply drag force to the contoured speed control plates 61*a* or 61*b*. It will be readily apparent to those skilled in the art that with appropriate modification of the mounting structure, the contoured speed control plate 61 can be applied to as many wheels as desired for adequate speed control. While not illustrated, it is also possible and considered to be within the scope of this invention, using either the actuating lever, or the cable of the present invention to have more than one speed control 33 applying downward pressure to a single contour speed control plate 61 or multiple contour speed control plates in more than one position along the frame rails 57*a* and 57*b*.

The preferred embodiment of the present invention wherein the contoured speed control plate 61 is housed substantially above the in-line roller wheels 35 and securely maintained between the frame rails 57*a* and 57*b*, has advantages over the prior art in that the speed control 33 is substantially removed from debris including rocks, dirt, grass, etc., which could become entangled in a speed control positioned lower on the frame rails 57*a* and 57*b*. In addition, by maintaining the speed control 33 substantially between the frame rails 57*a* and 57*b*, the present invention protects the components of the speed control from damage due to the lower frame portion 31 contacting rigid objects or being carelessly handled.

Referring to FIG. 16A, there is shown a perspective view of an embodiment of the present invention with the soft, pliable, breathable shoe portion 22 laminated in place on the base portion 39*a* as described above with respect to FIGS. 2B and 3B.

As discussed heretofore, FIG. 16B discloses the base portion 39 having a frame portion 31 molded integrally therewith. A soft upper shoe portion may be laminated therein in a known fashion such as by applying glue along the base and lower sides of the shoe in the area of the heel and toe supports and then curing.

While there are manufacturing cost advantages in having the upper shoe portion separable from the lower frame portion 31, it is also desirable in some skate designs for the base portion 39 to be both laterally and longitudinally adjustable with respect to the lower frame portion. It is also advantageous to have the base portion 39 molded integrally with the lower frame portion 31. More specifically, certain rigidity improvements can be obtained by eliminating the interface between the base portion 39 and the lower frame portion 31, and eliminating the fastening means used to securely hold the two components together.

Figure 17:
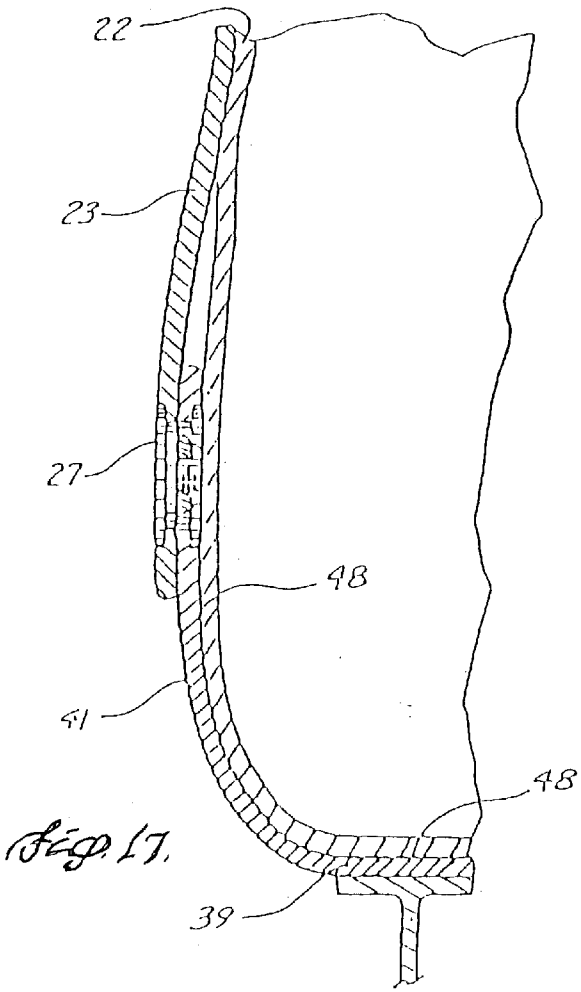
FIG. 17 is a sectional rear view of the upper shoe portion, showing the heel counter and ankle support cuff.

Referring now to FIG. 17, there is shown a rear sectional view of the embodiment of FIG. 16A of the present invention showing an ankle support cuff 23, a soft, pliable, breathable shoe portion 22, a lateral canting means 27 and an external heel counter 41. As discussed heretofore, adhesive may be applied at interface 48 to bond the shoe portion 22 to the heel counter 41 and the base portion 39.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An in-line roller skate for receiving the foot of a skater, the skate comprising:

a frame having a plurality of longitudinally aligned wheels rotatably secured thereto;

a base securely attached to the frame, the base including a rigid sole having a heel portion and a toe portion adapted to support the bottom of the skater's foot, the base further including an at least semi-rigid heel counter secured to the heel portion and an at least semi-rigid toe cap secured to the toe portion;

an upper shoe portion formed from a substantially flexible material, at least a part of the upper shoe portion being breathable, the upper shoe portion adapted to substantially cover the instep and ankle of the skater's foot and being attached to the base such that at least a part of the upper shoe portion is in contact with the sole, the upper shoe portion further including a releasable fastener adapted for securing the upper shoe portion around the foot of the skater, iucluding the instep of the skater's foot; and an at least semi-rigid ankle support cuff having an adjustable support strap, the ankle support cuff being pivotally coupled to the heel counter to provide lateral support for the upper shoe portion and leaving a substantial part of the upper shoe portion exposed during use, including a majority of the part of the upper shoe portion that is over the instep of the skater's foot.

2. The in-line roller skate of claim 1, wherein the upper shoe portion is laminated to the toe cap.

3. The in-line roller skate of claim 2, wherein the ankle support cuff is slidably coupled to the upper shoe portion.

4. The in-line roller skate of claim 3, wherein the heel counter is rigid.

5. The in-line roller skate of claim 4, wherein the toe cap is formed from plastic.

6. The in-line roller skate of claim 5, wherein the ankle support cuff is rigid.

7. The in-line roller skate of claim 1, wherein the heel counter is an integral part of the base.

8. The in-line roller skate of claim 1, wherein the upper shoe portion further comprises an external lace cover.

9. The in-line roller skate of claim 1, wherein the rigid sole is contoured to include an arch support.

10. The in-line roller skate of claim 1, wherein the base is adjustably fastened to the frame.

* * * * *